US005751316A

United States Patent [19]

Bailey et al.

[11] Patent Number: 5,751,316

[45] Date of Patent: May 12, 1998

[54] THERMAL INK JET PRINTHEAD WITH INK RESISTANT HEAT SINK COATING

[75] Inventors: Raymond E. Bailey, Webster; Robert K. McCubbin, Rochester; Manfred H. Goeserich, Churchville; Robert P. Altavela, Farmington, all of N.Y.

[73] Assignee: Xerox Corporation, Stamford, Conn.

[21] Appl. No.: 674,493

[22] Filed: Jul. 1, 1996

[51] Int. Cl.[6] ..... B41J 2/05

[52] U.S. Cl. ..... 347/63; 29/890.1

[58] Field of Search ..... 347/20, 56, 60, 347/61, 63, 64, 66, 67, 100, 104; 29/890.1

[56] References Cited

U.S. PATENT DOCUMENTS

| | | | |
|---|---|---|---|
| Re. 32,572 | 1/1988 | Hawkins et al. | 156/626 |
| 4,851,371 | 7/1989 | Fisher et al. | 437/226 |
| 5,010,355 | 4/1991 | Hawkins et al. | 346/140 R |
| 5,258,781 | 11/1993 | John | 347/63 |
| 5,297,336 | 3/1994 | Burolla | 29/890.1 |
| 5,333,007 | 7/1994 | Kneezel et al. | 347/20 |
| 5,519,429 | 5/1996 | Zwjsen et al. | 347/223 |
| 5,585,825 | 12/1996 | Kneezel et al. | 347/14 |

OTHER PUBLICATIONS

Metal Finishing, vol. 92, No. 1A published 1994.

*Primary Examiner*—Matthew V. Nguyen

[57] ABSTRACT

A heat sink for a thermal ink jet printhead has improved resistance to the corrosive effects of ink by forming a chromate film on a copper plated metal substrate. In one described embodiment, a thermal ink jet printer is formed by bonding together a channel plate and a heater plate. Resistors and electrical connections are formed in the surface of the heater plate. The heater plate is bonded to a heat sink comprising a zinc substrate having a copper film plated on one surface. The copper plated heat sink is immersed in a chromic acid and water bath. Metal anodes are placed within the bath and a field is applied for a period of time sufficient to form a polymeric chromate film on the copper plated surface. The chromate film has improved resistance to ink corrosion and exhibits a stronger printhead to heat sink bonding strength.

17 Claims, 2 Drawing Sheets

THERMAL INK JET PRINTHEAD WITH INK RESISTANT HEAT SINK COATING

BACKGROUND OF THE INVENTION AND MATERIAL DISCLOSURE STATEMENT

This invention relates to an ink jet printing device which uses energy to cause ink droplets contained within channels formed internally to the printhead to be expelled from an orifice onto a recording material. More particularly, the invention relates to an ink jet printhead having improved protection from the corrosive effects of high pH ink on the heat sink portion of the printhead.

In the ink jet printing art, a printhead is provided having one or more ink filled channels communicating with an ink supply chamber, the channels having one end formed as a nozzle orifice. The ink forms a meniscus at the nozzle prior to being expelled. Energy is applied to the ink channels in the form of heat created by pulsing heating resistors or by a piezoelectrically applied force to the channel walls to cause an ink droplet to be expelled from the nozzle onto the recording material. After a droplet is expelled, additional ink replenishes the channel and reforms the meniscus.

The ink must flow in such a manner that the energy generator, either the resistor heater element in a thermal ink jet printer or piezoelectric plates in the piezo printer are in sufficient contact to transfer energy to the ink. Because of the corrosive nature of the ink used (typically having pH 8 or higher), ink sensitive portions of the printhead must be protected by a protective coating. Co-pending application U.S. Ser. No. 229,253 assigned to the same assignee as the present invention, discloses a method for protecting the electronic circuitry used to supply drive signals to the heating resistors in a heating plate. Portions of the heating plate are covered with a polyimide layer which is coated with an ink resistant layer of either tantalum or amorphous carbon.

Another area of the printhead which is susceptible to corrosive effects of high pH inks is the heat sink which is used to mount the die of a thermal ink jet printer. Heat sinks are typically constructed of good heat conductive metal such as zinc coated with another metal which bonds readily to the printhead die. Typically, zinc die castings are provided corrosion protection by a series of plating/processing steps that starts with first applying a thin deposit of copper from a high throwing power copper cyanide or pyrophosphate bath, and then plating to the required copper thickness from an acid copper sulfate electrolyte. Selection of the final coatings is application dependent. For marine and industrial exposures, hardware is typically treated with a combination of coatings that provide galvanic protection; i.e., sacrificial corrosion protection, such as is obtained with bright nickel and chromium metal layers. A problem with the metal selected to coat the zinc die is that complexes are formed with any species having free electron pairs. Water, ammonia, amino-, imino-, hydroxyl- or thiol- groups are some examples of complexing agents with free electron pairs. Consequently, inks with one or more components containing such groups can easily attack the nickel or copper coating layers on contact with the heat sink. This invariably happens during normal printing. As a result, the heat sink corrodes over a period of time. Apart from the loss in cosmetic appearance of the heat sink, the more serious aspect of such corrosion is the likelihood of debonding of the die from the substrate.

Another likely source of corrosion is the electrolytic reaction between a coating metal such as nickel and zinc in the presence of moisture.

SUMMARY OF THE INVENTION

It is an object of the present invention to provide an ink jet printing device wherein an ink resistant barrier coating is formed on the printhead heat sink to protect the heat sink from the corrosive effects of the ink.

It is another object of the invention to provide a protective layer which is inert to chemical attack by the ionic and molecular species in the ink.

It is a still further object to form an ink resistant coating on a metal heat sink which is stable at bonding temperatures.

It is another object to extend the useful pH range of thermal ink jet printheads.

These, and other objects, are realized by copper plating a zinc heat sink and forming a polymeric chromate barrier film on the plating. The chromate film is formed by either an immersion or a cathodic chromate treatment. The copper plated heat sink, with the chromate barrier film formed on its surface, exhibits greater resistance to the effects of ink erosion and, when bonded to a printhead, provides a stronger bond at the bonding interface.

More particularly, the present invention relates to a thermal ink jet printer for ejecting ink onto a recording medium including:

- a printhead including at least a channel for holding said ink,
- at least one nozzle for ejecting said ink onto the recording medium,
- heater means for selectively heating the ink in said channel causing ink in said channel to be ejected from said nozzle and
- a heat sink having a surface to which said printhead is bonded, said heat sink comprising a metal substrate having a thin copper plated film formed on the substrate surface and a thin chromate film overlying the copper plated film, the printhead bonded to a surface of said chromate film.

The invention is also related to a method for forming a heat sink member having at least one surface with improved ink corrosion resistance, comprising the steps of:

a) copper plating the surface of a metal substrate to a thickness of between 0.0004 and 0.0007 inch;

b) preparing an electrolyte bath of chromic acid and water, the bath having a pair of anodes dispersed therein;

c) immersing the plated substrate into the bath while applying an electrical field across the anodes for a period of time sufficient to form a thin polymeric chromate film;

d) removing the cathodic chromated heat sink from the bath and e) drying the heat sink.

DESCRIPTION OF THE INVENTION

Figure 1:
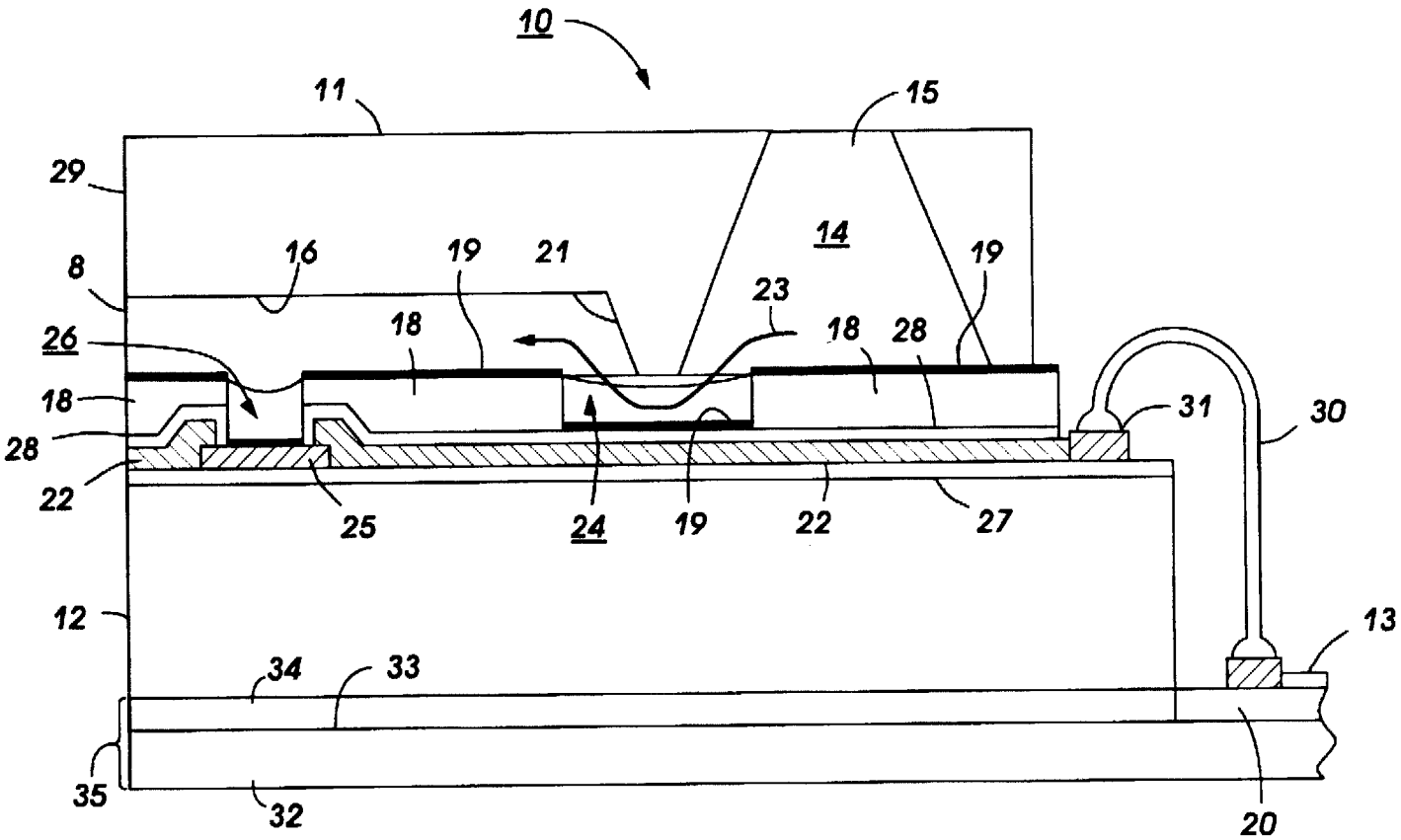
FIG. 1 is an enlarged cross-sectional view of a thermal ink jet printer showing a heat sink having a polymeric chromate ink resistant coating film formed on a copper plated heat sink surface.

The invention will be described in conjunction with a thermal ink jet printer of the type disclosed in U.S. Pat. No. Re. 32,572 to Hawkins et al., U.S. Pat. No. 5,010,355 to Hawkins et al., U.S. Pat. 4,851,371 to Fisher et al., and U.S. Pat. No. 5,297,336 to Burolla, the disclosures of all of which are hereby incorporated by reference. It is understood that the invention has utility to other types of printhead structures as will be seen. As disclosed in these patents, thermal ink jet printheads are generated in batches by aligning and adhesively bonding an anisotropically etched channel wafer to a heater wafer followed by a dicing step to separate the bonded wafers into individual printheads. The printheads are then bonded to a heat sink which, in turn, is bonded to a daughterboard carrying the electrical connections to the printhead. FIG. 1 shows a cross-sectional view of a printhead having a heat sink protected by an ink resistant coating according to the principles of the present invention. Printhead 10 comprises an anisotropically etched channel plate 11 aligned and bonded to heater plate 12. The printhead at a surface of plate 12 is bonded to heat sink 35 by a silver epoxy. Heat sink 35 comprises, in one embodiment, a zinc substrate 32, a copper plated film 33 and a polymeric chromate film 34, deposited by techniques described below. Also mounted on heat sink 30 is a daughter board 20 having electrodes 13 thereon which connect to a drive circuit and power supply (not shown). The channel plate 11 has a through etched reservoir 14 with its open end serving as inlet 15 and a plurality of channels 16 anisotropically etched therein. Ends of the channels 16 open through nozzle face 29 and terminate at slanted ends 21. The open ends of the channels serve as nozzles 8. The heater plate has an array of heating elements 25 and addressing electrodes 22 formed on the surface of the heater plate 12 which confronts the channel plate. The heating elements and electrodes are formed on an insulative layer 27 and are passivated by another insulative layer 28. Thick film insulative layer 18, in a preferred embodiment, is a 10 micron thick photosensitive polyimide interposed between the heater plate and the channel plate. Layer 18 is patterned and cured to expose the heating elements, thereby placing them in separate pits 26 to form ink flow bypass pits 24 between the reservoir 14 and the ink channel 16. Layer 18 is also patterned to expose the electrode bonding terminals 31. Following the patterning step, layer 18 is allowed to cure. Ink thus flows from reservoir 14 to channels 16 around the closed end of the channels 21 as shown by arrow 23. The terminals 31 are connected to the daughter board electrodes 13 by wire bonds 30. The anisotropically etched channels 16 have a triangular cross-sectional area and the materials surrounding the nozzle at the nozzle face 29 is silicon on two sides of the triangular shaped nozzle and thick film layer material layer on the third side.

The ink during normal print mode and the absence of film 34, tends to corrode copper plated film 33 and gradually affects the printhead to heat sink bond. However, and according to the invention, chromate film 34 provides a stronger and more stable heat sink overcoating which provides greater resistance to ink corrosion and better preserves the printhead to heat sink bonding.

Figure 2:
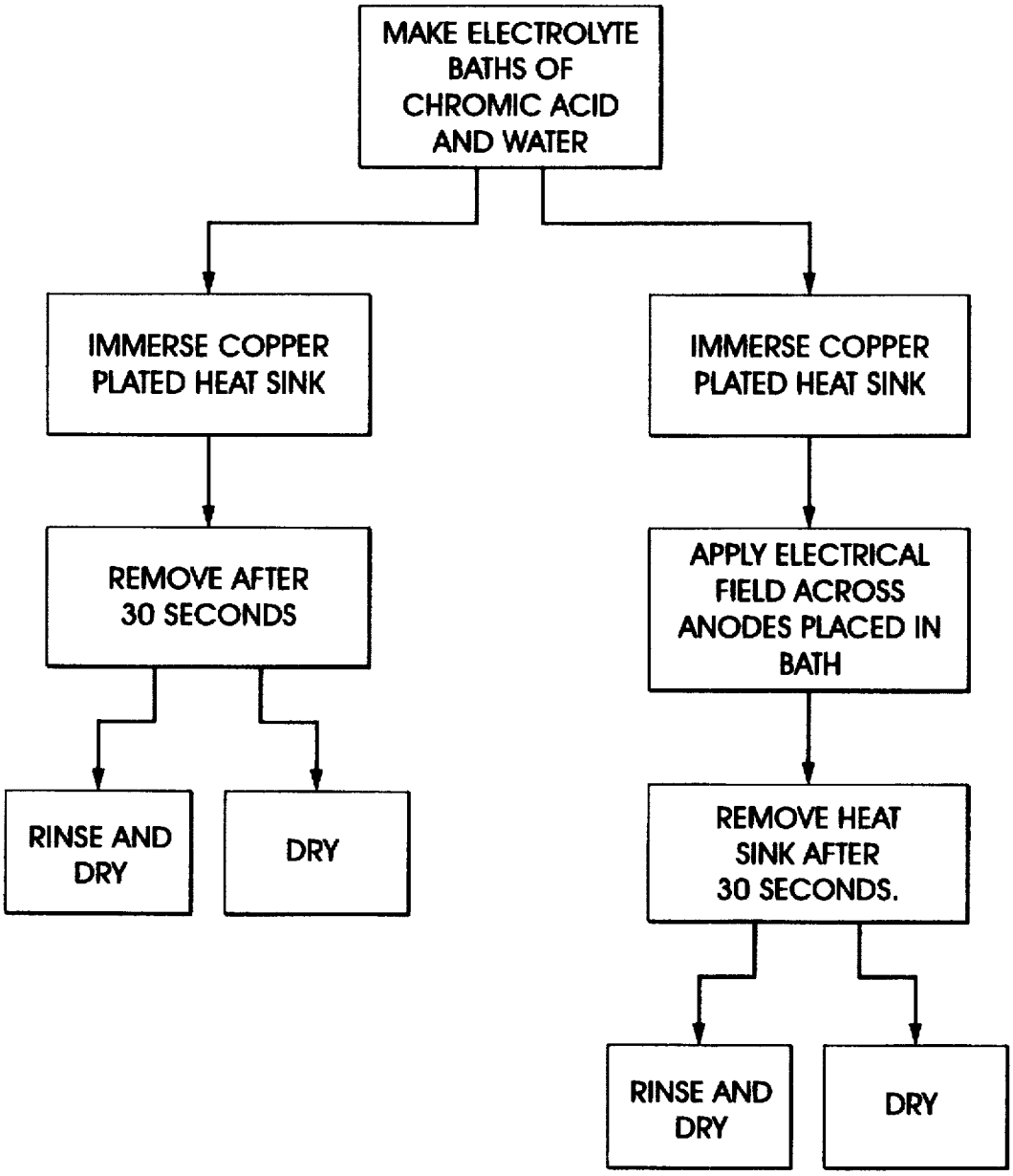
FIG. 2 is a flow diagram of two processes used to form the ink resistant film of FIG. 1.

The chromate coating can be formed on the copper plated heat sink surfaces in either an immersion or a cathodic chromating process. Examples will be given for each process and with reference to FIGS. 1 and 2.

EXAMPLE I—IMMERSION

A zinc die casting 32 is subjected to a copper plating process to provide film 33 of copper on a surface. Film 33 is comprised of an initial deposit of copper from a pyrophosphate bath followed by a plating to the final plating thickness of approximately 0.0006 inch using an acid copper sulfate electrolyte. An immersion bath comprising 3 g/l chromium trioxide in deionized water and operated at ambient temperature is used. The copper plated zinc coating is suspended for approximately 30 seconds in the bath resulting in a thin oxide layer of copper and chromium (chromate film 34) being formed. Typical thicknesses range from 50 to 500 angstroms. The heat sink 35 is then removed and either rinsed and oven dried at 90° C. or removed and simply dried at that temperature without rinsing.

EXAMPLE II

Copper film 33 is formed on the surface of zinc substrate 32 as in Example I. The same $H_2$ $CRO_4$ bath is prepared as in Example I. Film 34 is formed by a cathodic chromating process as follows:

a) In the same container as the bath, a pair of dimensionally stable anodes, lead in the preferred embodiment, are immersed.

b) The copper plated heat sink is immersed in the bath.

c) The electrodes are connected across the terminals of a 30 volt dc power supply; the heat sink being the cathode and connected to the negative terminal.

d) The heat sink is immersed for approximately 30 seconds until chromate film 34 is formed.

e) The applied voltage is terminated and the heat sink is removed from the bath.

f) The heat sink is then dried as in Example I.

COMPARATIVE RESULTS

The ink corrosion reduction (passivation) of the chromate passivated copper plated heat sink of Examples I and II was measured by an Open Circuit Corrosion Potential (OCP) testing procedure performed on three samples made by each process and against two copper plated control samples.

A second test was conducted to measure heat sink to printhead sheer strength after prolonged immersion in various inks at elevated temperatures.

CORROSION TESTING

Open circuit corrosion potential (OCP) voltage measurements were taken referenced to a standard calomel electrode (SCE). The negative numbers in the third, fourth and fifth columns of Table I are indicative of passivation of the heat sinks. The table shows comparative results of two sets of samples formed from the immersion (Example I) process and the cathodic (Example II) process. A control group of samples (copper plated heat sinks only) was tested as a control. The heat sink samples were tested at 5 seconds and 60 seconds after immersion with a third measurement at 60 seconds combined with a stirring step. Additional tests were conducted to determine the effect of rinsing, or not rinsing, the sample after removal from the bath, and the effect for the cathodic treatment of entering/exiting the bath with or without the applied voltage. The two series of samples were prepared on consecutive days. The OCP's were measured immediately after cooling to room temperature after baking on the day they were prepared. All samples were cleaned by a 15 second immersion in 10% by weight sodium persulfate, and successive tap and DI water rinse and blown dry before baking at 90° C. for five minutes. The OCP vs. SCE measurements were made in 3% by weight Na Cl, 0.2% $CuSO_4.5H_2O$, pH adjusted to 3.0 with Hcl. A second set of measurements were made on all samples on the third day. Thus, the first set of samples at this point had two days of exposure to lab ambient, the second set had one day exposure. Three measurements are recorded. When the sample is introduced into the electrolyte, the OCP rapidly changes, and just starts to stabilize after about 5 seconds at which the first measurement is recorded. A second measurement is recorded after an additional 55 seconds under quiescent conditions. Immediately after the 60 seconds recording, the electrolyte is stirred, and the third measurement taken. It is believed that only the 60 seconds and stir reading are important. The 60 seconds measurement is indicative of the relative passivity. The difference between the 60 seconds and the stir readings is an indication of polarization in the mixed potential measurement.

Samples 1 and 6 are the control samples; 2 and 7 are the chromate heat sinks formed by the immersion with rinsing; and samples 3 and 8 are the chromate heat sink formed by immersion without rinsing; sample 4 is cathodic chromate heat sink with rinse and field applied after immersion; sample 5 is cathodic chromate heat sink without rinse and field applied after immersion; sample 9 is cathodic chromate heat sink with rinse and field applied at time of immersion and removal; and sample 10 is cathodic chromate heat sink without rinse and with field applied at time of immersion and removal.

The following conclusions can be made:

1. The cathodic chromate treatment provides a more passive and durable bonding surface, and hence, greater resistance to ink erosion than either the immersion chromate treated heat sink or the control (copper plated only) heat sinks.
2. The immersion chromate treated heat sink provided a more passive bonding surface than the control.
3. Entering/exiting the bath with voltage applied has no apparent effect on passivity.
4. Rinsing the cathodic chromate samples resulted in a slight decrease in passivity from the non-rinsed sample.

A visual inspection of the samples confirm the above observations. Samples 1 and 6 (control) and 2, 3 and 7 (immersion chromate rinsed) showed a residual tarnish after six days at lab ambient. The cathodic chromate samples, 4, 5, 9 and 10, showed no evidence of tarnishing after six days at lab ambient.

TABLE I

CORROSION POTENTIAL TESTING

| No. | Description | OCP vs SCE (mV) 5 SEC. | 60 SEC. | STIR |
|---|---|---|---|---|
| 1(A12) | Control: clean, bake | −108 | −117 | −111 |
| ditto | ditto | −100 | −114 | −107 |
| 2(a36) | Imm Cr 30 sec, rinse, bake | −133 | −127 | −127 |
| ditto | ditto | −105 | −114 | −111 |
| 3(a13) | Imm Cr 30 sec, no rinse, bake | −133 | −200 | −143 |
| ditto | ditto | −105 | −119 | −114 |
| 4(a51) | Cath. Cr 30 sec, rinse, bake | −218 | −220 | −162 |
| ditto | ditto | −115 | −185 | −125 |
| 5(a14) | Cath. Cr 30 sec, no rinse, bake | −270 | −220 | −180 |
| ditto | ditto | −130 | −190 | −145 |
| 6(a11) | as per no. 1 | −108 | −123 | −110 |
| ditto | ditto | −100 | −115 | −108 |
| 7(a23) | as per no. 2 | −125 | −125 | −123 |
| ditto | ditto | −100 | −117 | −112 |
| 8(a46) | as per no. 3 | −128 | −230 | −178 |
| ditto | ditto | −125 | −175 | −135 |
| 9(a21) | as per no. 4, except enter/exit live | −228 | −198 | −160 |
| ditto | ditto | −135 | −182 | −175 |
| 10(a22) | as per no. 5, except enter/exit live | −278 | −220 | −182 |

TABLE I-continued

CORROSION POTENTIAL TESTING

| No. | Description | OCP vs SCE (mV) 5 SEC. | 60 SEC. | STIR |
|---|---|---|---|---|
| ditto | ditto | −160 | −203 | −173 |

DIE BOND SHEARING

Die bonding shearing tests were conducted by bonding the printhead 10 (FIG. 1) to the heat sinks having copper plated films 33 only (sample 1) and to heat sinks with the immersion and cathodic chromate film 34 overlying film 33. The printhead/heat sink assembly was then immersed in a black water based ink containing a total of approximately 13.6% by weight of a mixture of black and red dye, approximately 77% b. Wt. of water and approximately a total of 9.4% b. Wt. of Cosolvent/Humectant/Biocide and Jetting Aid. The ink solution has an approx. pH=7.43, a viscosity of 1.32 cps and a Surface Tension of 53.8 dynes/cm. The samples were removed and then subjected to shear testing to determine the shear value/lb. at which separation of the heat sink from the printhead occurs. The results are shown in Table II. The mean shear values, in lbs., are in columns 3 and 5. The testing was conducted at the rate of 0.050"/min.

The following observations can be made:

1. The construction exhibiting the most resistance to shearing forces (and hence, best preserving the printhead to heat sink bond) is a cathodic chromate, rinsed sample

TABLE II

DIE SHEAR ADHESION RESULTS

| Heat Sink Construction | No. Tested | Controls | No. Tested | After Ink Immersion - 14 Days @ 50 C |
|---|---|---|---|---|
| Copper Plated Only (No Chromate) | 2 | 36.37 | 4 | 7.95 |
| Copper Plated With Cathodic Chromate/ Rinsed | 6 | 94.36 | 5 | 25.75 |
| Copper Plated With Cathodic Chromate/Not Rinsed | 4 | 119.91 | 5 | 16.26 |
| Copper Plated With Immersion Chromate | 8 | 86.7 | 5 | 12.01 |

2. The cathodic chromate, rinsed, or not rinsed, results provide a shearing resistance superior to the immersion chromate.
3. Both of the chromate constructions, immersion and cathodic, provide superior shear bonding than the untreated, copper-plated only, heat sink.

While the embodiments disclosed herein is preferred, it will be appreciated from this teaching that various alternative, modifications, variations or improvements therein may be made by those skilled in the art, which are intended to be encompassed by the following claims:

We claim:

1. A thermal ink jet printer for ejecting ink onto a recording medium including:

a printhead including at least a channel for holding said ink, at least one nozzle for ejecting said ink onto the recording medium, a heater for selectively heating the ink in said channel causing ink in said channel to be ejected from said nozzle and a heat sink having a surface to which said printhead is bonded, said heat sink comprising a metal substrate having a thin copper plated film formed on the substrate surface and a thin chromate film overlying the copper plated film, the printhead bonded to a surface of said chromate film.

2. The printer of claim 1 wherein said chromate film is an inorganic polymer of copper and chromium oxides.

3. The printer of claim 1 wherein said chromate film has a thickness of between 50 and 500 angstroms.

4. The printer of claim 1 wherein said metal substrate is zinc.

5. A method for forming a heat sink having at least one surface with improved ink corrosion resistance, comprising the steps of:

a) copper plating a surface of a metal substrate to form a copper plated film having a thickness of between 0.0004 and 0.0007 inch;

b) preparing an electrolyte bath of chromic acid and water, the bath having a pair of anodes dispersed therein;

c) immersing the cooper plated metal substrate into the bath while applying an electrical field across the anodes for a period of time sufficient to form a polymeric chromate film of between 50 and 500 angstroms on the copper plated metal substrate, which acts as a cathode, thereby forming a cathode chromated heat sink;

d) removing the heat sink from the bath and e) drying the heat sink.

6. The method of claim 5 further including the step of rinsing the heat sink after removal from the bath.

7. The method of claim 5 including the further step of bonding an ink jet printhead to a surface of the polymeric chromate film to form a printhead and heat sink assembly.

8. The method of claim 5 wherein said period of time is approximately 30 seconds and the applied field is approximately 12 volts.

9. A method for forming a heat sink having at least one surface with improved ink corrosion resistance, comprising the steps of:

a) copper plating the surface of a metal substrate;

b) preparing an electrolyte bath of chromic acid and water;

c) immersing the copper plated substrate into the bath for a period of time sufficient to form a chromate coated film of $H_2CRO_4$ on a surface thereof to a thickness of between 50 and 500 angstroms the chromated coated film and underlying substrate constituting a heat sink;

d) removing the heat sink from the bath and e) drying the heat sink.

10. The method of claim 9 including the further step of rinsing the heat sink after removal from the bath.

11. The method of claim 9 including the further step of bonding an ink jet printhead to a surface of the chromate coated film to form a printhead and heat sink assembly.

12. The method of claim 9 wherein said period of time is approximately 30 seconds.

13. In a printing system wherein a thermal ink jet printhead ejects a recording liquid onto a recording medium, the printhead having an internal structure which includes at least a chamber for holding said recording liquid, at least a nozzle for ejecting said liquid onto the recording medium, channel means providing a liquid flow path between said chamber and said nozzle, an energy generating means for introducing energy into the liquid contained in said channel and means for selectively energizing said energy generating means so as to cause periodic ejections of said liquid through said nozzle onto said recording medium, the printing system characterized by said printhead being bonded to the surface of at least a partially conductive heat sink substrate for conveying heat away from said printhead, the substrate having a thin chromate film at the bonding surface.

14. The printhead of claim 13 wherein said chromate film is formed on a copper film plated onto an underlying metal substrate.

15. The printhead of claim 13 wherein said chromate film is formed by immersing said copper plated substrate in a chromic acid and water bath.

16. The printhead of claim 14 wherein the printhead includes an upper substrate comprising a channel plate etched to form a set of parallel groves, the grooves serving as said channel means and a lower substrate comprising a heater plate, said energy generating means comprising an array of heater elements formed on said lower substrate surface, said means for selectively energizing said energy generating means including electrode bonding terminals formed on said lower substrate surface, the upper and lower substrates, when aligned and bonded together forming said printhead and wherein said printhead is bonded to said heat sink.

17. The printhead of claim 14 wherein the chromate film is formed by immersing said copper plated substrate in a chromic acid and water bath and applying a field to an anode within the bath, the copper plated substrate acting as the cathode.

* * * * *